US007866077B2

(12) United States Patent
Constant et al.

(10) Patent No.: US 7,866,077 B2
(45) Date of Patent: Jan. 11, 2011

(54) STRIKER ASSEMBLY FOR USE WITH A FIREARM

(75) Inventors: Robert L. Constant, Westfield, MA (US); John Pliska, Hadley, MA (US); Richard A. Picard, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 313 days.

(21) Appl. No.: 11/971,486

(22) Filed: Jan. 9, 2008

(65) Prior Publication Data

US 2010/0281738 A1 Nov. 11, 2010

Related U.S. Application Data

(60) Provisional application No. 60/884,251, filed on Jan. 10, 2007.

(51) Int. Cl.
*F41A 19/57* (2006.01)

(52) U.S. Cl. ..... 42/69.02; 89/27.11

(58) Field of Classification Search ..... 42/69.02; 89/27.11

See application file for complete search history.

(56) References Cited

U.S. PATENT DOCUMENTS 2,679,645 A * 6/1954 Erickson et al. ..... 227/11
2,787,000 A * 4/1957 Smith et al. ..... 227/9
3,934,303 A * 1/1976 Neithercutt ..... 15/406

* cited by examiner

*Primary Examiner*—Stephen M Johnson
(74) *Attorney, Agent, or Firm*—McCormick, Paulding & Huber LLP

(57) ABSTRACT

A striker assembly for a firearm and a method of assembly the striker assembly is disclosed. The striker assembly includes a generally cylindrical body having a first distal end, a middle portion, and a second distal end. A coaxial spring encompasses the middle portion of the body and abuts an annular ring on the first distal end. The striker assembly also has a spacer having a first side and a second side with the first side of the spacer abutting a ridge on the second distal end of the body. A snap ring holds the spacer in place on the spacer's second side, and the snap ring is secured by a circumferential groove in the second distal end of the body. Finally, the striker assembly includes a cap that abuts the coaxial spring and encompasses the second distal end of the body, the spacer, and the snap ring.

12 Claims, 4 Drawing Sheets

STRIKER ASSEMBLY FOR USE WITH A FIREARM

CROSS REFERENCE TO RELATED APPLICATIONS

This application claims the benefit of U.S. Provisional Application Ser. No. 60/884,251, filed on Jan. 10, 2007, herein incorporated by reference in its entirety.

FIELD OF THE INVENTION

The present invention relates to a striker assembly for use with a firearm. More particularly, it relates to a striker assembly that is easy to assemble and contains fewer parts.

BACKGROUND OF THE INVENTION

Fire control mechanisms used in semiautomatic handguns oftentimes utilize striker-type firing pins. In handguns that employ a striker-type firing pin, the trigger is connected to a trigger bar. Movement of the trigger causes movement of the trigger bar, which, in certain embodiments, causes a sear to rotate about a pivot point. The sear is typically an elongated element that is rotatable about a pivot point located substantially at one end thereof. Upon rotation of the sear, a spring is compressed, and an upper portion of the sear is displaced relative to the firing pin. When the sear is displaced a sufficient distance to clear a depending leg of the firing pin, the firing pin is urged forward by a firing pin spring and strikes the rear of an ammunition cartridge, thereby discharging the firearm.

Striker assemblies are well known in the art. Typically, a striker assembly contains several small and intricate parts. Assembly can often be difficult and costly.

For these reasons, known striker assemblies have several disadvantages. The present invention overcomes these disadvantages by providing a striker assembly with a unique design that is easy to assemble with a lower part count.

SUMMARY OF THE INVENTION

An object of the present invention is to provide a striker assembly that functions with a minimum number of parts.

Another object of the present invention is to design a striker assembly that is easy to assemble.

Still another object of the present invention is to provide a striker assembly that eliminates the use of pins, which are typically difficult and time-consuming to install.

These and other objectives of the present invention, and their preferred embodiments, shall become clear by consideration of the specification, claims, and drawings taken as a whole.

According to one aspect of the present invention, a striker assembly includes a striker body that is generally cylindrical with both end portions being diametrically reduced. The striker body has a raised annular ring near the forward end of the striker body and a ridge or flange and a circumferential groove near the rear end of the striker body. The striker assembly also includes a coaxial spring, which slides over the rear part of the striker body and abuts the raised annular ring at one end. A spacer is shaped to fit around the striker body and slides over the rear part of the striker body and abuts the ridge. A snap ring slides over the rear part of the striker body until it is held in place by the circumferential groove of the striker body. A cap slides over the rear part of the striker body and the spacer and abuts the other end of the coaxial spring.

DETAILED DESCRIPTION OF THE PREFERRED EMBODIMENT

Figure 1:
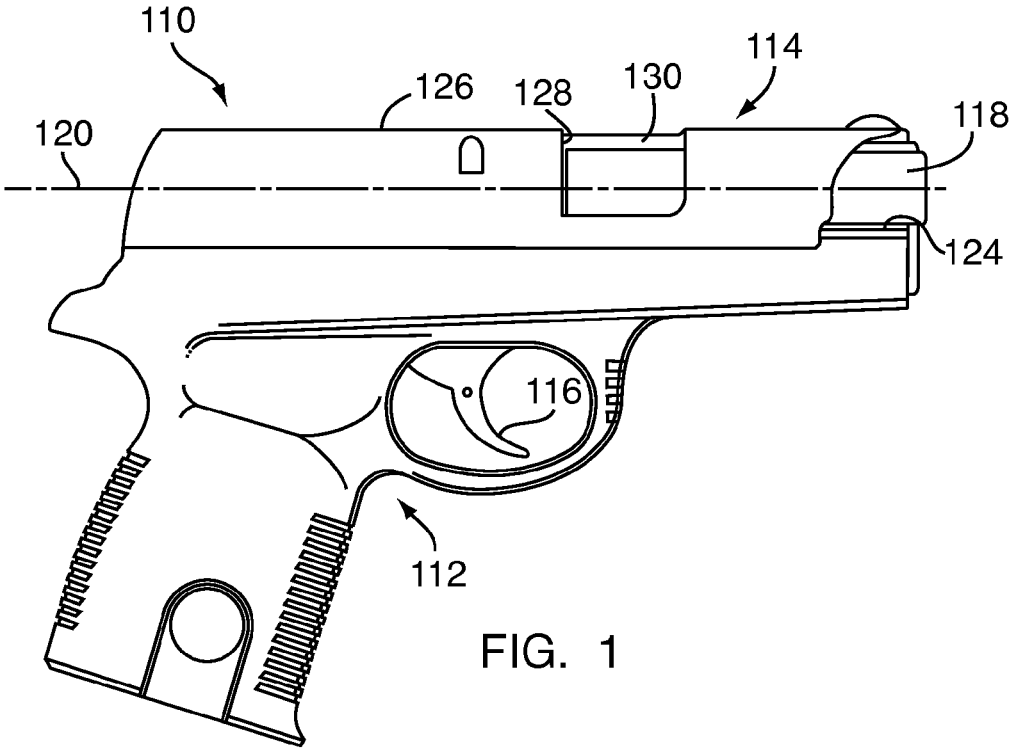
FIG. 1 is a simplified schematic side view of a semiautomatic pistol.
Figure 2:
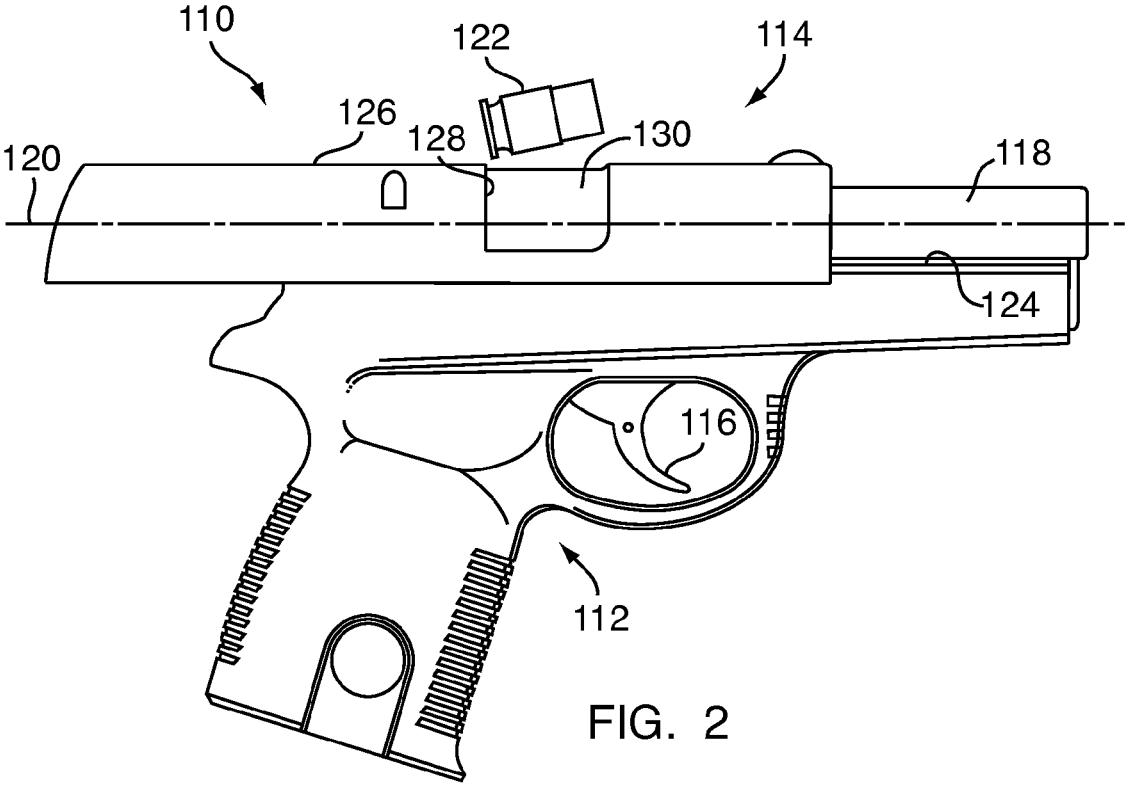
FIG. 2 is a simplified schematic side elevation view of the pistol of FIG. 1 shown with the slide moved to a rearward position on the pistol frame.

FIGS. 1 and 2 show one example of a semiautomatic pistol or handgun (hereinafter referred to as "firearm 110") that may incorporate a striker assembly 10 according to an embodiment of the present invention. The firearm 110 comprises a frame 112, a slide 114, and a fire control mechanism that operates via actuation of a trigger 116. The frame 112 is fabricated of a high-impact polymer material, metal, a combination of polymer and metal, or other suitable material. The slide 114 houses a barrel 118 in the forward end thereof. The barrel 118 is cooperatively linked with the slide 114 and, together with the slide 114, defines a longitudinal firing axis 120. A rearward end of the barrel 118 is adapted for receiving an ammunition cartridge 122.

The slide 114 is fitted to oppositely positioned rails 124 on the frame 112 to effect the reciprocal movement of the slide 114 along the longitudinal firing axis 120. The rails 124 extend along the underside of the slide 114 in the longitudinal direction and are cooperative with the frame 112 to allow the cycling of the slide 114 between forward (battery) and rearward (retired) positions. The slide 114, which is defined by a slide frame 126, further includes a breech face 128 and an extractor port 130. The breech face 128 is engagable with the rearward end of the barrel 118 to form a firing chamber when the slide 114 is disposed forwardly on the frame 112 (FIG. 1). An ejection mechanism provides for the ejection of a cartridge casing 122 upon firing the firearm 110 or manually cycling the slide 114.

Figure 3:
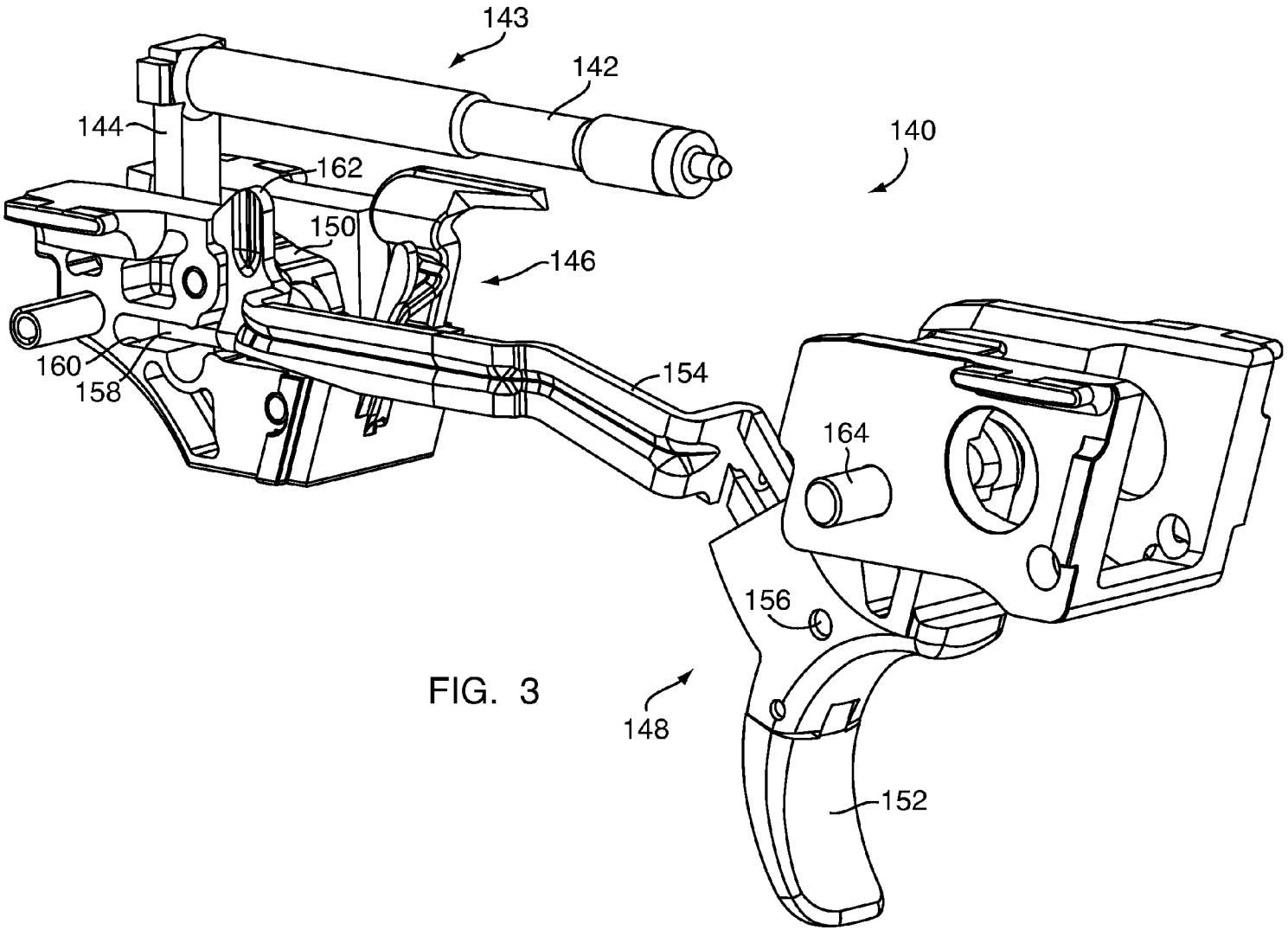
FIG. 3 is a simplified schematic perspective view of a trigger assembly and a sear assembly portion of a semiautomatic pistol.

Referring now to FIG. 3, the fire control mechanism 140 is shown. The fire control mechanism 140 is of a known striker-type firing pin configuration and comprises a striker-type firing pin 143 ("striker") having a firing pin portion 142 and a depending leg 144. The fire control mechanism 140 further comprises a sear assembly 146 and a trigger assembly 148. The sear assembly 146 includes a pivotally mounted sear 150 that engages the striker 143. The trigger assembly 148, which functions to actuate the sear 150, includes a trigger 152 and a trigger bar 154 pivotally connected to the trigger 152 via a pin 156. The trigger bar 154 functionally connects the trigger 152 and the sear assembly 146. A trigger bar extension 158 extends from the trigger bar 154 into a channel 160 of the sear assembly 146, and an arm-like trigger bar safety deactivation member 162 extends substantially vertically from the trigger bar 154. The trigger 152 may be of unitary construction, as shown, or of a multiple-piece articulated construction.

When the trigger 152 is actuated by being pressed in a rearward direction, the trigger 152 pivots about a pin 164 and transmits movement to the trigger bar 154 via the pin 156. The trigger bar 154 is thereby moved in a rearward direction substantially parallel to the longitudinal firing axis 120 such that the trigger bar extension 158 correspondingly translates in the channel 160. A portion of the trigger bar 154 operationally abuts the sear 150 for actuating the sear 150 when the trigger bar 154 is moved rearwards. However, the connection of the trigger assembly 148 and the sear assembly 146 is such that the trigger bar 154 is laterally displaced out of abutment/engagement with the sear 150 when sufficient force is exerted on the trigger bar extension 158 in a direction that is perpendicular to the direction in which the longitudinal firing axis extends.

Figure 4:
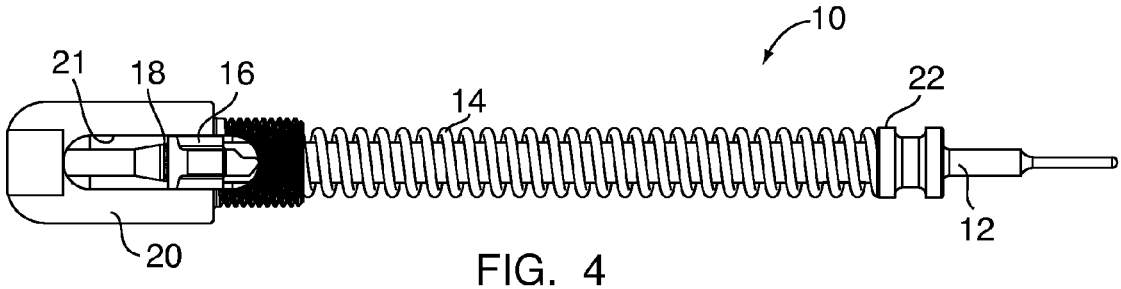
FIG. 4 is a simplified schematic side view of a striker assembly provided in accordance with the present invention.

The present invention is directed to a striker assembly for use with the firearm 110 and provides several advantages over known strikers, such as striker 143. FIG. 4 shows one embodiment of the present invention in a simplified schematic form. In FIG. 4, a striker assembly 10 has a striker body 12, a coaxial spring 14, a striker spacer 16, a snap ring 18, and a cap 20.

Figure 6:
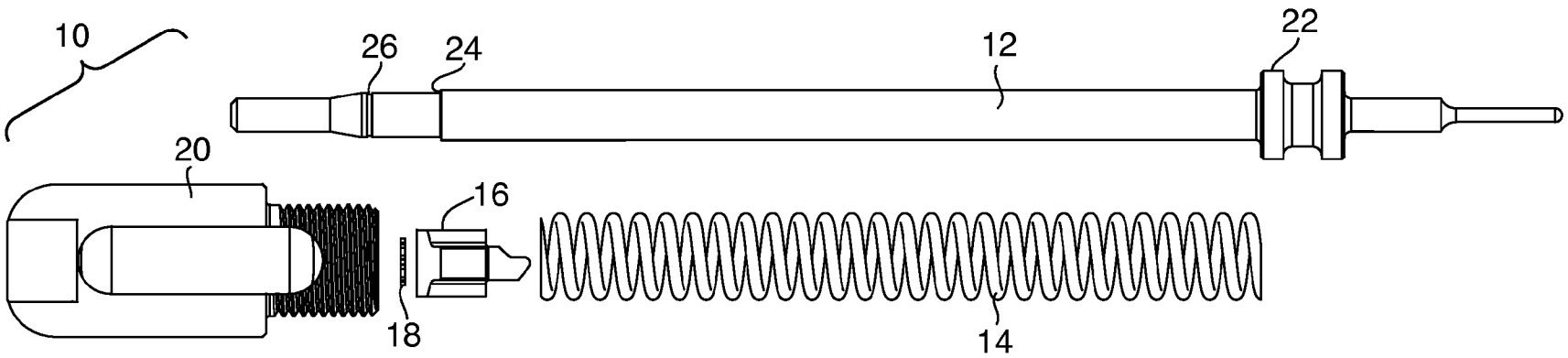
FIG. 6 is a simplified schematic exploded side view of the striker assembly of FIG. 4.

As best shown in FIG. 6, the striker body 12 extends the entire length of the striker assembly 10. The striker body 12 is generally cylindrical with both end portions being diametrically reduced. The forward end of the striker body 12 is reduced in diameter and features a pin-shaped end for striking the ammunition primer. Prior to the reduction in diameter of the forward end, the striker body 12 has a raised annular ring 22. From the end of the rear part of the striker body 12, the diameter steadily increases until it reaches a circumferential groove 26. After the circumferential groove 26, the diameter remains constant. This region accommodates the spacer 16. After the region for the spacer 16, the striker body 12 has a small ridge 24, where the diameter of the striker body increases slightly and remains constant until it reaches the raised annular ring 22 near the forward end.

Returning to FIG. 4, the middle portion of the striker body 12 is encompassed by the coaxial spring 14. The diameter of the middle portion of the striker body 12 should be slightly less than the internal diameter of the spring 14 so that the spring 14 may slide across the striker body 12 during assembly. At the forward end of striker body 12, the coaxial spring 14 abuts the flat surface of the raised annular flange or ring 22 of the striker body 12. At the rear part of the striker body 12, the spring 14 abuts the cap 20 in its assembled state. Spring 14 is able to slide over the rear portion of striker body 12 until it abuts with the flat surface of the raised annular ring 22 of the striker body 12.

Figure 5:
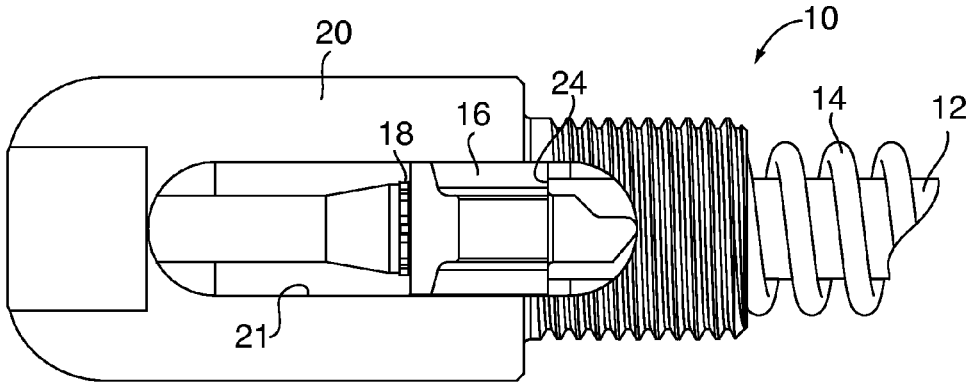
FIG. 5 is an enhanced view of a portion of one end of a simplified schematic side view of the striker assembly of FIG. 4.

The rear part of striker assembly 10 can best be seen in FIG. 5. The spacer 16 is also able to slide over the rear portion of the striker body 12 and is stopped by ridge 24 (shown in FIG. 6). The spacer 16 is shaped to fit around the striker body 12, and the diameter of its hole matches the diameter of the striker body 12 when the spacer 16 slides into its desired location, which is the region between the ridge 24 and the circumferential groove 26. The spacer 16 is not able to slide past the ridge 24 since the diameter of ridge 24 is greater than the internal diameter of the hole of spacer 16.

Spacer 16 is held in place on the end opposite ridge 24 by snap ring 18. Snap ring 18 is able to slide over the rear part of the striker body 12. As the diameter of the striker body 12 increases, the snap ring 18 spreads apart and increases its internal diameter. When it reaches the circumferential groove 26 of the striker body 12, the snap ring 18 snaps into place in its relaxed state and maintains the position of the spacer 16. The larger diameter prior to the circumferential groove 26 prevents the snap ring 18 from being displaced from the striker body 12 until an individual manually increases the internal diameter of the snap ring 18 so that it can slide over the rear part of the striker body 12.

Figure 7:
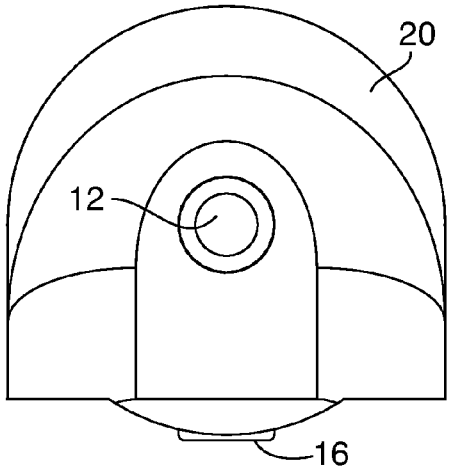
FIG. 7 is a simplified schematic rear view of the striker assembly of FIG. 4.

The cap 20 is the final part involved in the assembly. The cap 20 is designed to slide over the spacer 16 and the rear part of the striker body 12. As shown in FIG. 7, the rear part of the cap 20 contains a hole, which has an internal diameter that is equal to the diameter of the striker body 12 at the circumferential groove 26. During assembly, the cap 20 is pushed toward the forward end of the striker body 12. This force pushes and locks the snap ring 18, spacer 16, and spring 14 into its proper place on the striker body 12. The cap 20 is able to push all of the parts due to its hole at its rear, which allows the rear part of the striker body to extend past the exterior of the cap 20. In its assembled state, the end of the cap 20 abuts one end of spring 14. The spring 14 is held in place by raised annular ring 22 and cap 20. The cap 20 is held in place by spacer 16.

As described above and shown in FIGS. 4-7, the present invention allows all of the parts to be slid into place and held together. Each piece holds another into its proper position, which eliminates the time-consuming process of pinning the parts. Elimination of pins results in easier assembly, which reduces costs. The present invention can be assembled into a single assembly that clicks together rather than previous designs where it is pinned.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A firearm, comprising:

a frame;

a slide operably connected to said frame;

a striker operably connected to at least one of said frame and said slide;

a fire control mechanism operably connected to said frame for selective actuation of said striker; and wherein said striker, comprises:

a generally cylindrical body having a first distal end, a middle portion, and a second distal end;

a coaxial spring encompassing said middle portion of said body and abutting an annular ring on said first distal end;

a spacer having a first side and a second side, said first side of said spacer abutting a ridge on said second distal end;

a snap ring holding said spacer in place on said second side, said snap ring being secured by a circumferential groove in said second distal end of said body; and a cap abutting said coaxial spring and encompassing a portion of said second distal end of said body, said spacer, and said snap ring.

2. The firearm of claim 1, wherein said first distal end terminates in a pin-shaped end.

3. The firearm of claim 1, wherein said cap further includes an aperture larger than the diameter of said second distal end of said body.

4. The firearm of claim 1, wherein said coaxial spring is secured by said cap.

5. The firearm of claim 1, wherein said cap is secured by said spacer.

6. A striker assembly for a firearm, comprising:

a generally cylindrical body having a first distal end, a middle portion, and a second distal end;

a coaxial spring encompassing said middle portion of said body and abutting an annular ring on said first distal end;

a spacer having a first side and a second side, said first side of said spacer abutting a ridge on said second distal end;

a snap ring holding said spacer in place on said second side, said snap ring being secured by a circumferential groove in said second distal end of said body;

a cap abutting said coaxial spring and encompassing said second distal end of said body, said spacer, and said snap ring.

7. The striker assembly of claim 6, wherein said first distal end terminates in a pin-shaped end.

8. The striker assembly of claim 6, wherein said cap further includes an aperture larger than the diameter of said second distal end of said body.

9. The striker assembly of claim 6, wherein said coaxial spring is secured by said cap.

10. The striker assembly of claim 6, wherein said cap is secured by said spacer.

11. A striker assembly for a firearm, comprising:

a striker pin that is generally cylindrical with both end portions, a forward end and a rear end, being diametrically reduced;

said striker pin having a raised portion near said forward end of said striker pin and a ridge and a recess near said rear end of said striker pin;

a coaxial spring which slides over said rear end of said striker pin and abuts said raised portion at one end;

a spacer shaped to fit around said striker pin which slides over said rear end of said striker pin and abuts said ridge;

a snap pin which slides over said rear end of said striker pin until said snap pin is held in place by said recess; and a cap which slides over said rear end of said striker pin and said spacer and abuts the other end of said coaxial spring.

12. The striker assembly of claim 11, wherein said cap further includes an aperture larger than a diameter of said rear part of said striker pin.

* * * * *